United States Patent [19]

Werner et al.

[11] Patent Number: 4,642,919

[45] Date of Patent: Feb. 17, 1987

[54] SUBMERSIBLE SLUDGE REMOVING APPARATUS

[75] Inventors: Roy H. Werner, Pittsburgh; Clifford Decker, Bethel Park, both of Pa.

[73] Assignee: Barrett, Haentjens & Co., Hazelton, Pa.

[21] Appl. No.: 707,146

[22] Filed: Mar. 1, 1985

[51] Int. Cl.[4] ..... E02F 3/88

[52] U.S. Cl. ..... 37/58; 37/71

[58] Field of Search ..... 37/56, 58, 71, 816.8, 37/72, 64–67, 61–63; 210/242.1; 172/26.5, 26.6; 114/125, 333, 121; 441/29, 28, 2

[56] References Cited

U.S. PATENT DOCUMENTS

| | | | |
|---|---|---|---|
| 70,849 | 11/1867 | Howell | 37/58 |
| 813,935 | 2/1906 | Avery, Jr. | 37/56 X |
| 1,619,850 | 3/1927 | Casey | 37/58 X |
| 2,952,083 | 9/1960 | Forkner | 37/58 X |
| 3,352,035 | 11/1967 | Joyce | 37/72 X |
| 3,465,374 | 9/1969 | Johnson et al. | 441/29 X |
| 3,495,409 | 2/1970 | Riedemann | 37/58 X |
| 3,588,174 | 6/1971 | Rossfelder et al. | 37/DIG. 8 |
| 3,683,521 | 8/1972 | Sloan et al. | 37/56 |
| 3,706,142 | 12/1972 | Brunner | 37/56 |
| 3,748,760 | 7/1973 | Schnell | 37/71 X |
| 3,804,177 | 4/1974 | Renfroe | 37/71 X |
| 3,975,842 | 8/1976 | Andreae | 37/58 |
| 4,470,208 | 9/1984 | Van Berk et al. | 37/63 |

FOREIGN PATENT DOCUMENTS

| | | | |
|---|---|---|---|
| 3129228 | 2/1983 | Fed. Rep. of Germany | 37/58 |

*Primary Examiner*—Clifford D. Crowder
*Attorney, Agent, or Firm*—William J. Ruano

[57] ABSTRACT

Apparatus for removing sludge from a settling basin, comprising a pair of longitudinally extending pontoons, spaced apart, and having mounted therebetween, a submersible pump for pumping the sludge. The pump is pivotally mounted between the pontoons and adjustably pivotal from a vertical position to a substantially horizontal position in either direction so as to vary the depth of the inlet to the pump and thereby variably dilute the sludge. Variable pivotal deflector plates are mounted across both ends of the pontoons and include means for deflecting sludge toward the pump inlet. The pontoons are provided with partitions to provide separate compartments which are separately fed with the desired mixture of water and air, to enable tilting of the pontoons as well as providing a variable ballast for submerging the pontoons and pump to the desired depth in the sludge pond.

5 Claims, 5 Drawing Figures

SUBMERSIBLE SLUDGE REMOVING APPARATUS

This invention relates to apparatus for removing sludge from a sludge basin or pond.

Present equipment for removing sludge from a sludge pond has disadvantages in requiring the use of an operator and in requiring great manual effort in breaking up or removing sludge from the pond, particularly sludge located at a considerable depth from the surface of the pond.

An object of the present invention is to provide a novel apparatus and method for easily removing or circulating sludge in a sludge basin so as to overcome the above-named disadvantages.

Another object of the present invention is to provide a highly economical and easily controlled apparatus and novel method for removing sludge from a sludge basin in a minimum amount of time and at minimum cost.

Other objects and advantages of the invention will become more apparent from a study of the following description, taken with the accompanying drawings wherein.

Figure 1:
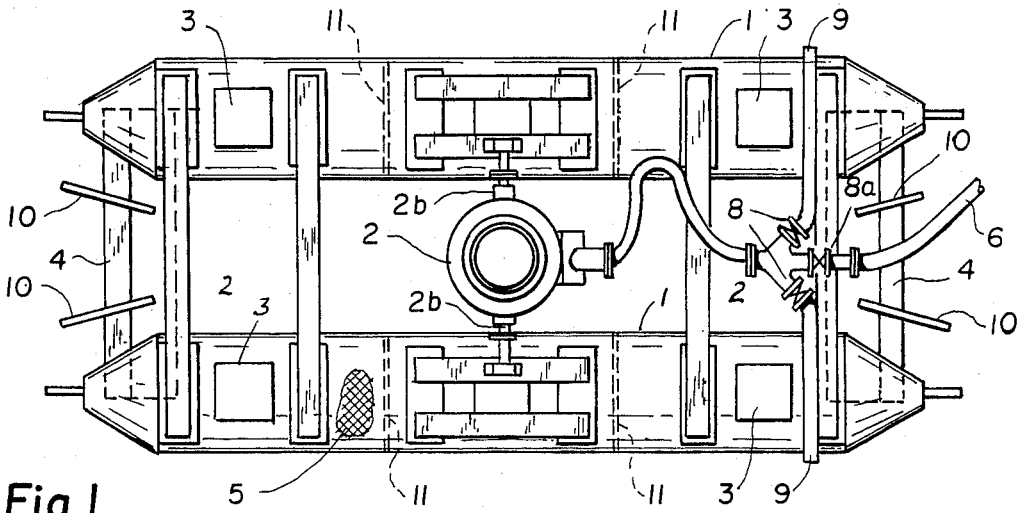
FIG. 1 is a plan view of apparatus for removing sludge and embodying the present invention.
Figure 2:
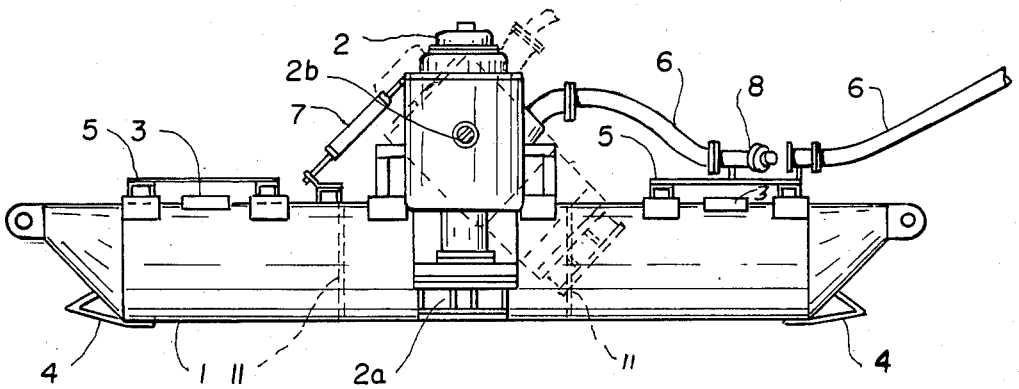
FIG. 2 is an elevational view thereof, taken along line 2—2 of FIG. 1.
Figure 3:
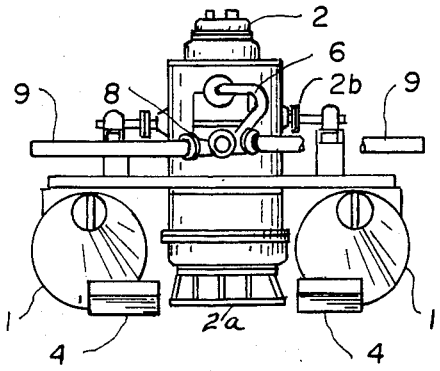
FIG. 3 is an end elevation thereof taken from the right of FIG. 1.

Referring more particularly to FIGS. 1, 2 and 3, numerals 1,1 denote a pair of pontoons, of steel or other suitable material, which extend longitudinally in spaced parallel relationship and which are provided with removable access hatches 3,3. Extending across the ends of the pontoons are variable pivotal angle iron or steel deflector plates 4,4 to facilitate breaking up of the sludge. Guide plates, flanges, or discs, 10,10 may be provided, if desired, on plates 4, to guide the broken up slurry toward the center of the apparatus and into the inlet 2*a* of pump 2 which is pivotally mounted on pivots 2*b*,2*b* between the pontoons. An expanded metal deck 5 is provided for servicing.

The pump 2 is a submersible pump of any well known type with an inlet 2*a* at the lower end which may be adjustably tilted to the position shown in dash lines to increase the height of inlet 2*a* and thereby dilute the sludge or slurry entering inlet 2*a*. While the dash lines are shown only for tilting in a counter-clockwise direction, it should be noted that the pump may be tilted also in a clockwise direction and that in either direction of tilt, the pump may be tilted to a substantially horizontal position so as to substantially increase the height of the inlet relative to the bottom of the pontoons.

The discharge outlet of the pump 2 flows into a flexible discharge hose 6 leading into a disposal or recovery area (not shown). The pump 2 may be selectively pivoted to any desired angle by a fluid cylinder 7 or other suitable means.

Discharge or recirculation control valves 8 are provided so that when the shutoff and bypass valve 8*a* is closed, the discharge of the pump will flow through recirculation line 9 so as to continuously recirculate and agitate the sludge, making the sludge more fluid. When valve 8*a* is opened, and valves 8 are closed, the sludge is discharged through the end of hose 6 into the disposal or recovery area.

Partitions 11 are provided in the pontoons so as to form separate compartments in each pontoon to enable selective mixtures of air and water to be introduced into each of the separate compartments. By such arrangement, for example, if the pontoons are filled with liquid in one end compartment, and air in the other end compartment, the pontoons will tilt into the pond at variable angles, depending upon the air—water mixture introduced into the respective compartments.

Figure 4:
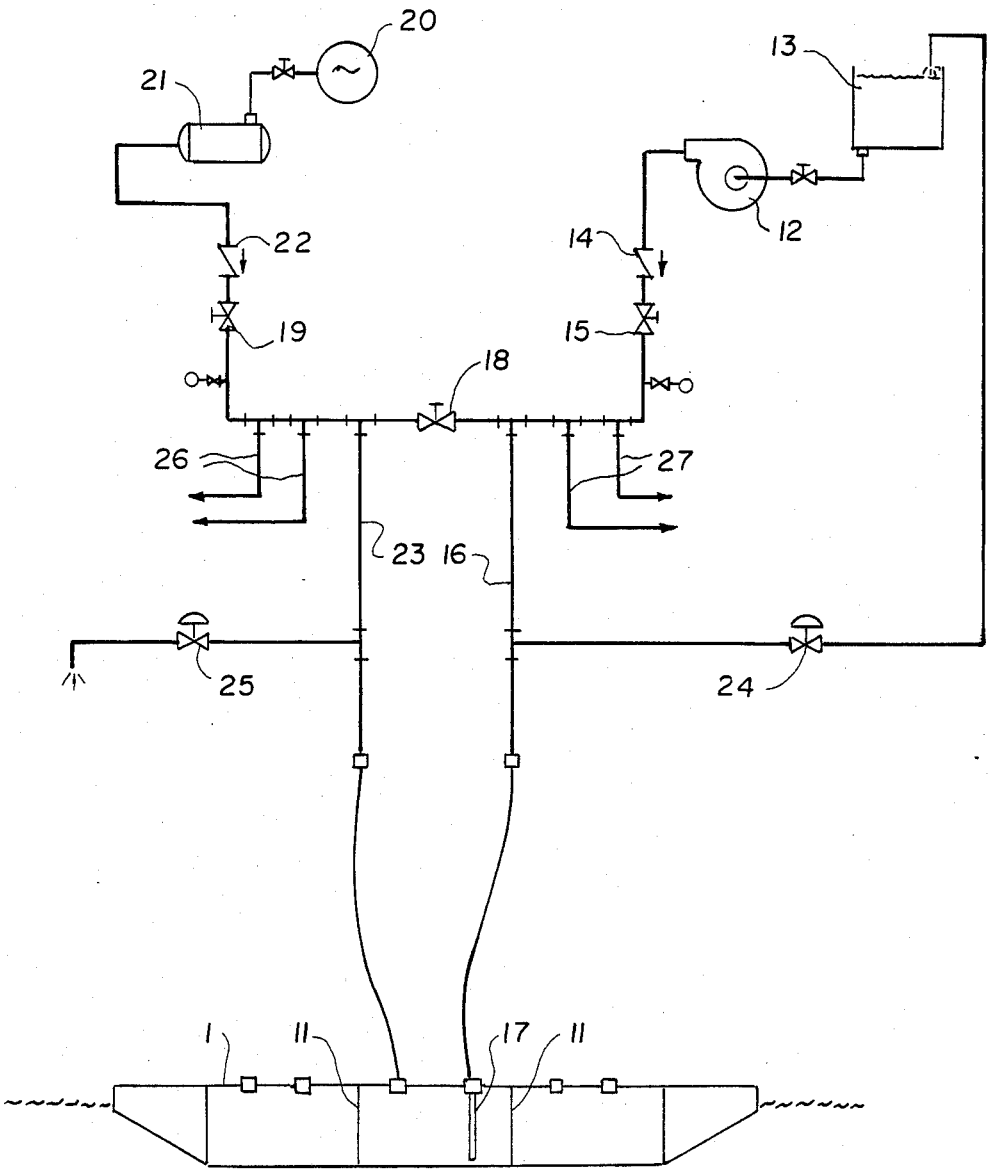
FIG. 4 is a schematic diagram showing the pumping system for the ballast tanks or pontoons.

FIG. 4 is a schematic diagram showing how one of the ballast tank compartments is fed with a variable air and water mixture. Pump 12 is fed by a tank 13 of water (on shore or barge) which water is pumped through a check valve 14, thence through control valve 15, through a "T" connection and through a water line 16 which leads to a water pipe outlet tube 17, discharging water into the bottom end of the compartment of the ballast tank, whereby the entire tank may be filled with water to serve as a ballast for sinking the pontoons.

When it is desired to remove the ballast water and replace it with air, to allow floating of the pontoons on the surface of the pond, control valve 15 is closed and air control valve 19 is opened to permit a compressor 20, feeding tank 21, to discharge air through a check valve 22, through a "T" connection to air line 23 so as to introduce air at the top of the ballast tank compartment which gradually forces water outwardly of tube 17 and through the exhaust valve 24 which may feed the supply tank 13.

While the system shown in FIG. 4 is for selectively introducing air and water in one compartment, the same system may be used for supplying air and water in variable amounts to the other compartments simply by tapping on opposite sides of the shutoff valve 18 in the manner shown by lines 26 and 27 provided with suitable shutoff valves.

The sludge removing apparatus is designed to rest on the shore of the sludge pond, while the pump is installed on the pontoons.

In operation, the apparatus is then pulled in the sludge bed by a cable winch or other power-operated means (not shown). When the sludge bed is just below the water level, the water can be pumped in the ballast tanks for added weight for sinking into the sludge. The apparatus is then pulled through the bed. The blades in the front and back of the apparatus break up the sludge and direct it to the pump suction.

The angle of the pump can be controlled by the cylinder actuated remotely. This angle can control the concentration of the sludge moving into the pump suction. The agitator on the inlet of the pump (not shown) also helps move the sludge in the pump inlet.

If the sludge is too viscous, the discharge valve and the by-pass valves can be adjusted for recirculation and agitation. The by-pass valve can be used for agitation only when the discharge valve is closed.

The apparatus can be pulled through the sludge with the by-pass valves open to recirculate the solids until fluid or until the pump 2 can move the slurry to bring the apparatus to the surface.

When the sludge bed is far below the water level, the water in the ballast tank can be removed with compressed air which replaces the water and the pontoons will float. The pontoons can be drawn on the surface of the water to the sludge bed. The procedure is reversed.

The air is forced to atmosphere by the water pressure and the pontoons sink to the sludge bed.

With this method of sludge removal, the sludge can be removed without disturbing the surface water quality.

The accessories for the apparatus can be located on shore. The two hoses required for compressed air and water can be attached to a power cable. A compressor 21 (low pressure) can be connected to pump for ballast or buoyancy.

Figure 5:
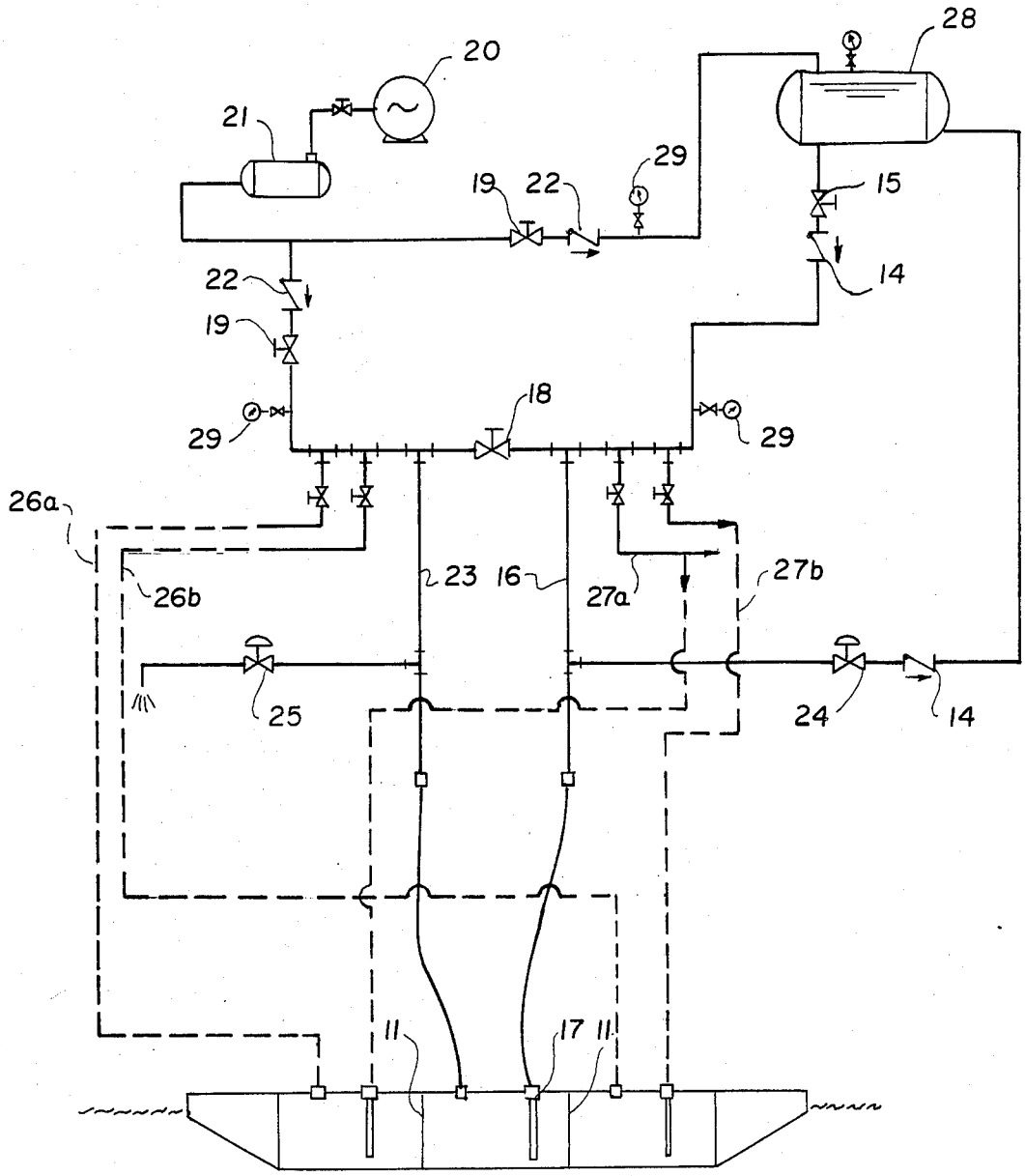
FIG. 5 is a modification.

FIG. 5 is a schematic diagram showing how a hydro-pneumatic tank is used and how one of the three ballast tank compartments is filled with water. Compressed air from the receiver 21 is fed through open valve 19 to the hydro-pneumatic tank 28. The compressed air forces the water in tank 28 through open valve 15 through "T" connection and through water line 16 which leads to a water pipe outlet tube 17, discharging water into the bottom end of compartment of ballast tank, whereby the entire tank may be filled with water to serve as a ballast for sinking the pontoons to sludge bed level.

When it is desired to remove ballast water and replace it with air, to allow floating of the pontoons on the surface of the pond, control valve 15 is closed and air control valve 19 is opened to permit a compressor 20, feeding compressed air from receiver 21 to discharge air through the check valve 22, through the tee connection to air line 23 so as to introduce air at the top of the ballast tank compartment which gradually forces water outwardly of tube 17 and through the exhaust valve 24 which may feed the supply tank 28.

Similarly, the left end compartment may be similarly operated through air line **26*a* and water line 27*a***, both shown in dash outline.

Likewise, the right end compartment may be similarly operated through air line **26*b* and water line 27*b***, both shown in dash outline.

Thus it will be seen that I have provided a highly maneuverable flotation apparatus, simulating a raft, which can be easily and quickly submerged to sludge bed surface to enable removal of sludge from considerable depths of the pond without disturbing the water above, and which can be easily tilted in either direction to nose down at selective angles, and wherein a pump carried thereby may be variably tilted in either direction to vary the height of the inlet of the pump and thereby variably dilute the sludge to enable it to be circulated by the pump.

The various valves shown, instead of being manually controlled from shore or barge, may be remotely controlled by well-known radio control means, and under adverse weather conditions. Thus an operator is not needed to man the sludge removing apparatus when using an automatic control panel to control the valves, as well as a power source to draw the apparatus through the sludge bed.

While I have illustrated and described several embodiments of my invention, it will be understood that these are by way of illustration only and that various changes and modifications may be contemplated in my invention within the scope of the following claims.

I claim:

1. Apparatus for removing sludge from a sludge basin, comprising pontoon means, a submersible pump having a suction inlet and a discharge outlet, said pontoon means comprising a pair of laterally spaced, longitudinal pontoons having a plurality of compartments into each of which selective amounts of air and water are introduced, said pump being vertically pivotal on said pontoon means so as to move said suction inlet to selective depths in the sludge basin to variably dilute the sludge, means for introducing selective amounts of air and water into said pontoon means to serve as a variable ballast to submerge and maintain said pontoon means at selective distances above the bottom of said basin, said pump having a discharge hose connected to said discharge outlet and extending beyond one end of said apparatus between said pontoons and having a pair of recirculation outlet hoses extending laterally outwardly on both sides of said apparatus, and valve means for selectively diverting pumped water to either said discharge hose or said recirculation outlet hoses.

2. Apparatus as recited in claim 1 wherein said valve means includes a closed liquid recirculating system.

3. Apparatus for removing sludge from a sludge basin, comprising a pair of laterally spaced, longitudinal pontoons, a submersible pump having a suction inlet and a discharge outlet, said pump being pivotally supported between said longitudinal pontoons so as to pivot said suction inlet from a vertically downward position to a substantially horizontal position in either direction to vary the dilution of the sludge pumped, each of said pontoons having a plurality of compartments, means for introducing into each of said compartments selective amounts of air and water so as to serve as a variable ballast to submerge and maintain said pontoons at selective distances above the bottom of said basin and to enable tilting of said pontoons at selective angles in either direction "fore" or "aft".

4. Apparatus as recited in claim 3 together with deflector plates mounted across both ends of said pontoons to deflect sludge toward the inlet of said pump.

5. Apparatus as recited in claim 4 together with guide plates mounted on said deflector plates to guide broken-up slurry toward the center of said apparatus and into said inlet.

* * * * *